United States Patent [19]

Bigelow

[11] 4,131,467

[45] Dec. 26, 1978

[54] 4,7-DIHYDROXYBENZIMIDAZOLE HYDROBROMIDE AS ANTIFOGGER

[75] Inventor: John H. Bigelow, St. Petersburg, Fla.

[73] Assignee: E. I. Du Pont de Nemours and Company, Wilmington, Del.

[21] Appl. No.: 854,262

[22] Filed: Nov. 23, 1977

[51] Int. Cl.[2] ..... G03C 5/30; G03C 1/34

[52] U.S. Cl. ..... 96/66.3; 96/66.5; 96/95; 96/109

[58] Field of Search ..... 96/107, 95, 109, 66.3, 96/66.5

[56] References Cited

U.S. PATENT DOCUMENTS

| | | | |
|---|---|---|---|
| 2,384,593 | 9/1945 | Bean | 96/66.5 |
| 2,418,613 | 4/1947 | Allen et al. | 96/109 |
| 2,893,865 | 7/1959 | Welliver et al. | 96/66.5 |
| 3,137,578 | 6/1964 | De Selms | 96/109 |
| 3,271,154 | 9/1966 | Dersch et al. | 96/66.5 |
| 3,499,761 | 3/1970 | Dersch et al. | 96/66.5 |
| 3,761,278 | 9/1973 | Gauss et al. | 96/109 |
| 3,850,638 | 11/1974 | Willis et al. | 96/107 |

OTHER PUBLICATIONS

Faerman — The Journal of Photographic Science, vol. 15, 1967, pp. 22–28.

Birr: Stabilization of Photographic Silver Halide Emulsions, The Focal Press, Oct. 1975, pp. 180–183.

*Primary Examiner*—Won H. Louie, Jr.

[57] ABSTRACT

Compounds of the general formula

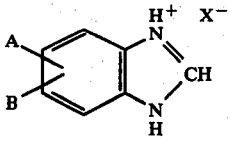

wherein A and B are hydroxy radicals in the 4,7 or 5,6 positions and $X^-$ represents $Br^-$, $Cl^-$ or $I^-$ are incorporated into light-sensitive silver halide emulsions to improve their sensitometric characteristics. In general, these compounds act as antifoggants by restraining fog growth but at the same time act as development accelerators by increasing gradient and Dmax, usually at some speed loss.

15 Claims, No Drawings

4,7-DIHYDROXYBENZIMIDAZOLE HYDROBROMIDE AS ANTIFOGGER

BACKGROUND OF THE INVENTION

This invention is directed to photographic materials comprising light-sensitive silver halide emulsions and, in particular, to stabilized silver halide emulsions which have less tendency to fog, and with little or no sacrifice of other sensitometry properties such as gradient, Dmax, and speed.

Gelatin-silver halide emulsions are subject to fogging, which may be defined as a uniform deposit of silver extending over and either partially or wholly obliterating the image. Fog may be caused in a number of ways, as for example, by excessive ripening of the emulsion, by storage of the light-sensitive element at elevated temperatures, and humidity, or by prolonged development of the exposed emulsion.

A great number of antifogging and stabilizing agents have been recommended in the literature for the purpose of preventing the formation of fog in light-sensitive silver halide emulsions. Although these compounds have the ability to control fog during manufacture, as well as during storage, many of these compounds adversely affect other sensitometric properties such as speed, gradient and Dmax. It is, accordingly, an object of this invention to provide a light-sensitive emulsion which has a reduced tendency to fog but at the same time retains a good balance of other sensitometric properties.

SUMMARY OF THE INVENTION

A dihydroxybenzimidazole hydrohalide of the formula

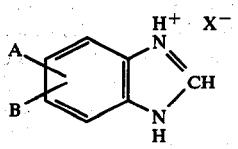

wherein (A) and (B) are hydroxy radicals in the 4,7 or 5,6 positions, and X is either Br, Cl, or I, is incorporated into a photographic element comprising a light-sensitive silver halide emulsion layer upon a support. It is preferred to incorporate the hydrohalide into the silver halide emulsion, but it is also possible to incorporate these compounds into an auxiliary layer which may or may not be contiguous to the emulsion layer, or into the developer bath used for processing the light-sensitive silver halide emulsion. These compounds act as antifoggants by restraining fog growth but at the same time act as development accelerators by increasing gradient and Dmax, usually at some speed loss.

DETAILED DESCRIPTION OF THE INVENTION

The dihydroxybenzimidazole hydrohalides of this invention consist of a fortuitous combination, in one molecule, of a developer, hydroquinone,

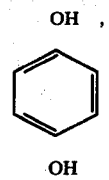

a development accelerator, tetraammonium ions,

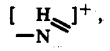

and the restrainers, Br, Cl, or I, and imidazole,

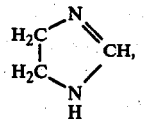

and at the same time produce greater Dmax, contrast and antifogging than an equimolar mixture of the separate compounds hydroquinone, KBr, and imidazole.

These compounds are water- and alcohol-soluble and can be added to silver halide emulsions from solution, or as a dry solid. In general, these compounds are added to a silver halide emulsion after it has been chemically sensitized with a conventional gold and sulfur sensitizer. The manner of addition is not critical, but preferably these compounds are added as a final addition just prior to coating the silver halide emulsion onto a support.

Examples of the dihydrozybenzimidazole hydrohalides used in the photographic elements of this invention are set forth below:

| Compound | Formula | Name |
|---|---|---|
| I | 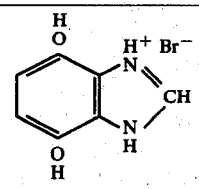 | 4,7-dihydroxybenzimidazole hydrobromide |
| II | 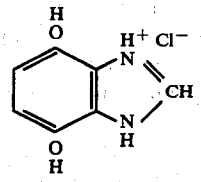 | 4,7-dihydroxybenzimidazole hydrochloride |
| III | 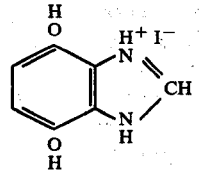 | 4,7-dihydroxybenzimidazole hydroiodide |
| IV | 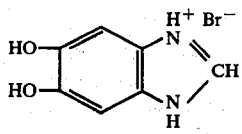 | 5,6-dihydroxybenzimidazole hydrobromide |

-continued

| Compound | Formula | Name |
|---|---|---|
| V | 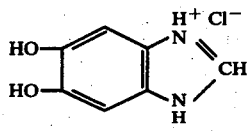 | 5,6-dihydroxy-benzimidazole hydrochloride |
| VI | 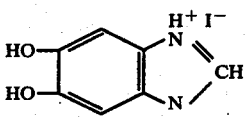 | 5,6-dihydroxy-benzimidazole hydroiodide |

These compounds may be incorporated in any type of light-sensitive silver halide emulsion layer, e.g., a spectrally sensitized or nonsensitized silver halide layer, a radiographic emulsion layer, and a high speed negative or positive light-sensitive emulsion. Of course, the amount to be added will vary dependent on the particular type of emulsion and can vary within wide limits. Enough compound is added to the emulsion to give good antifoggant properties without drastically affecting other sensitometric properties like speed, gradient or Dmax. Optimum amounts to be added can be determined for each emulsion by simple experiment as is customary in the art of emulsion manufacture. Generally, the most suitable concentration will be between $5 \times 10^{-6}$ mole to $10^{-2}$ mole of compound per mole of silver halide in the emulsion. However, greater or lesser amounts can be used.

The dihydroxybenzimidazole compounds can be prepared by the methods disclosed by Weinberger et al., J. Org. Chem. 24, 1451 (1959).

As stated above, these compounds can also be incorporated into the silver halide developer solutions. Generally, the most suitable concentration range is $10^{-6}$ to $10^{-2}$ mole per liter of developing solution with a preferred composition range of $10^{-4}$ to $10^{-3}$ mole of compound per liter of developing solution. Silver halide developers are well known in the art and contain such developing agents as hydroquinone and its derivatives (e.g., methylhydroquinone), catechol, pyrogallol and the like. Usually a pH greater than 8 is employed.

The silver halide constituent of the light-sensitive silver halide emulsion may be any of the usual types such as silver chloride, silver bromide, silver iodide or solid solutions thereof, in the form of single salt or mixed silver halide grains or crystals. These can be doped with other metal cations such as divalent lead or tin. These silver halide emulsion grains may be chemically sensitized with noble metal salts and labile sulfur compounds, e.g., gold chloride and sodium thiosulfate, as commonly practiced in the art of emulsion manufacture. Other addenda such as hardeners, wetting agents and plasticizers may be added in the usual manner.

Gelatin is the preferred binder for the silver halide grains, but it may be partially replaced with other material or synthetic binders as known in the art. Thus, binders used to increase covering power, e.g., dextran, dextrin, polyvinyl pyrrolidone, etc., as well as latices of polymers such as poly(ethyl acrylate) which are useful in improving dimensional stability and other physical properties are advantageously included in silver halide emulsions used in this invention.

The silver halide elements of this invention may include one or a plurality of emulsion layers, and may be coated on a support such as glass, paper or polymeric film (e.g., a polyester film).

This invention is illustrated by the following examples.

EXAMPLE I

A gelatino-silver chlorobromide emulsion was prepared by rapidly adding 1.5 moles of $AgNO_3$ in aqueous solution to an acidified solution of gelatin containing 1.5 moles of KCl. Then, there was added 0.6 mole of aqueous KBr solution, and the mixture was ripened for 10 minutes at 160° F. (~71° C.) after which there was added 0.9 mole of aqueous KBr solutions and the mixture was ripened for 10 minutes at 160° F. (~71° C.), coagulated, washed and redispersed.

To an amount of redispersed emulsion containing silver halide equivalent to 1.5 moles of $AgNO_3$, 124 grams of gelatin was added whereupon the temperature was raised to 110° F. (~43° C.). The emulsion was stirred until dissolution of the gelatin and the pH was adjusted to 6.5. Thereafter, the temperature was further raised to 125° F. (~52° C.) and $3.30 \times 10^{-6}$ moles of gold sensitizer and $1.74 \times 10^{-5}$ moles of sodium thiosulfate were added to the emulsion which was then digested for 60 minutes at 125° F. (~52° C.). After digestion, the pH was adjusted to 5.5, coating aids and a gelatin hardener were added and the emulsion coated on a suitable 0.004 inch (0.0102 cm.) polyester support to provide about 35–80 mg of silver halide per square decimeter, and dried in conventional manner.

The chlorobromide emulsion made in this manner served as control. To produce an emulsion which contains one of the additives of this invention, Compound I above was added to an emulsion made as described above after digestion. This emulsion contained the same coating aids and hardener, and was coated and dried in the same manner as the control emulsion.

In addition, a second control was made in the manner described above in which the known fog stabilizer, 4-hydroxy-6 methyl-1,3,3a,7-tetrazaindene, was added instead of a compound of this invention. Birr, Zeitschuft Fur Wissenschaftlichen Photographie, V. 47, 2–21 (1959) and Birr and Walther, AGFA: Wissenschaftlichen Photolaboratories Veroffentlickingen, V. 8, 23–48 (1959) disclose the stabilizing properties of this azaindene compound.

Film samples were exposed by two methods. In the first (hereinafter Exposure A) test samples were exposed for 4 seconds through a $\sqrt{2}$ optical wedge with actinic radiation equivalent to 4470 meter-candle-seconds and developed for 22 seconds at 100° F. (~38° C.) in a conventional phenidone-hydroquinone developer, fixed, washed and dried. For the second test (hereinafter Exposure B) samples were exposed for $10^{-6}$ seconds on an EG&G, Inc. sensitometer through a $\sqrt{2}$ optical wedge with actinic radiation equivalent to 29 meter-candle-seconds and developed 90 seconds at 80° F. (~27° C.) in a conventional hydroquinone developer, fixed, washed and dried. Sensitometric data were obtained by reading samples on a densitometer. These data are shown in the following table.

TABLE I

| Ctg. | Test* Age | Exposure A Dmin | Exposure A Dmax | Speed[1] (D=1.0) | Ave. Grad. | Exposure B Dmin | Exposure B Dmax | Additive |
|---|---|---|---|---|---|---|---|---|
| 1 | F | 0.04 | 2.21 | 295 | 1.18 | 0.04 | 2.07 | Control-none |
| 2 | O | 0.38 | 2.56 | 400+ | 1.36 | 0.38 | 3.50 | " |
| 3 | F | 0.04 | 1.72 | 100 | 0.73 | 0.04 | 1.17 | $1.76\times10^{-2}$ mole tetraazaindene |
| 4 | O | 0.06 | 1.24 | 34 | 0.49 | 0.06 | 1.24 | compound/mole Ag halide |
| 5 | F | 0.05 | 3.89 | 32 | 1.47 | 0.05 | 3.89 | $2.27\times10^{-4}$ mole compound I/ |
| 6 | O | 0.06 | 4.22 | 75 | 1.83 | 0.06 | 4.32 | mole Ag halide |

*F = Fresh, within a few days of coating
0 = Oven aged 1 week at 65% RH at 120° F (~49° C)
[1]speed and gradient were calculated at a net density of 1.0.

These data show that Compund I has antifoggant properties equivalent to the tetraazaindene control. In addition, by comparison to the two controls, Compound I in chlorobromide emulsion also exhibits development acceleration properties. While restraining fog, this compound increases contrast and Dmax with some sacrifice in speed.

EXAMPLE II

Control emulsions and emulsions containing Compounds I, II, and III of this invention were made and coated as described in Example I except that during precipitation of the emulsion grains the temperature was 154° F. (~68° C.) instead of 160° F. (~71° C.), $NH_4Cl$ was used instead of KCl, and 0.20 mole percent $Pb(NO_3)_2$ was added to the gelatin solution into which $AgNO_3$ flows. Fresh and oven aged samples were tested under Exposure A and B as described above in Example I. The results of those tests follow in Table II.

Table II shows the effect of Compounds I, II and III on the sensitometric properties of lead-doped chlorobromide emulsion. Compound I exhibits antifoggant properties similar to the tetraazaindene compound while, at the same time, shows superior development acceleration properties, i.e., increased gradient and Dmax. Compared to the control without additives, Compound I exhibits antifoggant and development acceleration properties. Compounds II and III, compared to the control without additives, are primarily development accelerators rather than antifoggants.

EXAMPLE III

Control and test emulsions were made as described in Example II except the test emulsions contained the 5,6 dihydroxybenzimidazole hydrohalides IV, V and VI. Samples were tested fresh and oven aged under exposures A and B as described in Example I. The results of those tests follow in Table III.

TABLE II

| Ctg. No. | Test Age | Exposure A Dmin | Exposure A Dmax | Density at* Step 2 | Density at* Step 10 | Ave. Grad. | Exposure B Dmin | Exposure B Dmax | Additive |
|---|---|---|---|---|---|---|---|---|---|
| 1 | F | .05 | .69 | .21 | .68 | .46 | .05 | .46 | Control-None |
| 2 | 0 | .59 | 1.69 | | | | .72 | 1.04 | |
| 3 | F | .03 | .65 | .09 | .43 | .26 | .05 | .51 | $1.76\times10^{-2}$ mole tetraazaindene/ |
| 4 | 0 | .05 | .48 | | | | .03 | .10 | mole Ag halide |
| 5 | F | .04 | 1.03 | | | | .05 | .46 | $4.53\times10^{-4}$ mole compd. I/mole |
| 6 | 0 | .08 | 1.64 | | | | .06 | .79 | Ag halide |
| 7 | F | .05 | 1.07 | .09 | .86 | .59 | .04 | .49 | $2.27\times10^{-4}$ mole Compd. I/mole |
| 8 | 0 | .14 | 2.39 | | | | .16 | 1.20 | Ag halide |
| 9 | F | .04 | .74 | | | | .04 | .49 | $2.27\times10^{-5}$ mole Compd. I/mole |
| 10 | 0 | .52 | 1.49 | | | | .48 | 1.00 | Ag halide |
| 11 | F | .04 | 1.91 | | | | .04 | .56 | $2.27\times10^{-4}$ mole Compd. II/mole |
| 12 | 0 | .49 | 1.63 | | | | .45 | 1.18 | Ag halide |
| 13 | F | .05 | 1.41 | .63 | 1.39 | .96 | .05 | .83 | $2.27\times10^{-5}$ mole Compd. II/mole |
| 14 | 0 | .87 | 1.59 | | | | .78 | 1.10 | Ag halide |
| 15 | F | .05 | 1.54 | .58 | 1.54 | 1.20 | .05 | .91 | $2.27\times10^{-4}$ mole Compd. III/mole |
| 16 | 0 | .98 | 1.18 | | | | 1.10 | .84 | Ag halide |
| 17 | F | .04 | 1.16 | | | | .05 | .68 | $2.27\times10^{-5}$ mole Compd. III/mole |
| 18 | 0 | .52 | 2.01 | | | | .79 | 1.03 | Ag halide |

*Here speed is indicated by the density at steps 2 and 10 in the $\sqrt{2}$ step wedge.

TABLE III

| Ctg. No. | Test Age | Exposure A Dmin | Exposure A Dmax | Exposure B Dmin | Exposure B Dmax | Additive |
|---|---|---|---|---|---|---|
| 1 | F | .05 | 1.47 | .05 | 1.15 | Control-none |
| 2 | 0 | .20 | 2.20 | .15 | 1.63 | |
| 3 | F | .04 | .60 | .03 | .45 | $1.73\times10^{-2}$ mole tetra-azaindene Compd./mole |
| 4 | 0 | .05 | 1.04 | .05 | .54 | Ag halide |
| 5 | F | .03 | 1.02 | .03 | 1.00 | $2.67\times10^{-4}$ mole Compd. IV/ |
| 6 | 0 | .05 | 2.25 | .04 | .67 | mole Ag halide |
| 7 | F | .04 | .92 | | | $2.67\times10^{-4}$ mole Compd. IV/ |
| 8 | 0 | .17 | 2.18 | .15 | 1.39 | mole Ag halide |

TABLE III-continued

| Ctg. No. | Test Age | Exposure A Dmin | Exposure A Dmax | Exposure B Dmin | Exposure B Dmax | Additive |
|---|---|---|---|---|---|---|
| 9 | F | .19 | 2.08 | | | $2.67\times10^{-4}$ mole Compd. VI/ |
| 10 | 0 | .43 | 1.69 | .30 | 1.43 | mole Ag halide |

These results show the 5,6-dihydroxybenzimidazole hydrohalides act in the same manner as the 4,7-dihydroxybenzimidazoles describes in Example II in lead-doped chlorobromide emulsions but not to the same degree.

EXAMPLE IV

To a chlorobromide control emulsion made as described in Example I there was added, after digestion, $1.76 \times 10^{-2}$ mole of 4-hydroxy-3 methyl-1,3,3a,7,tetraazaindene per mole of Ag halide. A test emulsion was made by adding to the control emulsion not only the tetraazaindene compound in the amount just stated, but also an amount of $2.27 \times 10^{-4}$ mole of Compound VI per mole of Ag halide. Fresh and oven aged samples were tested under Exposure B as described in Example I and the results follow in Table IV.

TABLE IV

| Ctg. No. | Test Age | Exposure B Dmin | Exposure B Dmax | Additive |
|---|---|---|---|---|
| 1 | F | .02 | .38 | $1.76\times10^{-2}$ mole tetraazaindene Compd./mole Ag halide |
| 2 | 0 | .02 | .28 | |
| 3 | F | .02 | .68 | $1.76\times10^{-2}$ moles tetraazaindene Compd. + $2.27\times10^{-4}$ moles Compd. VI/mole Ag |
| 4 | 0 | .04 | .47 | halide |

These data show that when Compound VI is added to a $Pb^{+2}$ doped chlorobromide emulsion containing a fog stabilizer, increased density is obtained with little or no increase in fog.

EXAMPLE V

A control gelatino-silver iodobromide containing 1.6 mole percent silver iodide was made by rapidly adding a solution containing 1.5 moles of $AgNO_3$ plus 3.0 moles $NH_3$ to a gelatin solution containing 1.486 moles of KBr and 0.024 moles KI. This mixture was ripened five minutes t 135° F. (~57° C.) whereupon acetic acid was added to neutralize the $NH_3$, and the resulting emulsion was coagulated, washed and redispersed. This emulsion was sensitized, digested and coated as described in Example I.

To a second iodobromide control emulsion, made in the above manner, the fog stabilizing compound 4-hydroxy-6 methyl-1,3,3a,7-tetraazaindene was added after digestion. Similarly, a test emulsion was made wherein Compound I was added to the iodobromide control emulsion after digestion. Fresh and oven aged samples were tested under Exposure A, and the results follow in Table V.

TABLE V

| Ctg. No. | Test Age | Dmin | Dmax | Speed (at D=1. O) | Ave. Grad. | Additive |
|---|---|---|---|---|---|---|
| 1 | F | .04 | 3.16 | | | Control-none |
| 2 | 0 | .20 | 3.67 | | | |
| 3 | F | .04 | 3.20 | 100 | 1.61 | $1.76\times10^{-2}$ mole tetraazaindene |
| 4 | 0 | .04 | 3.54 | 150 | 1.63 | Compd./mole Ag-halide |
| 5 | F | .05 | 5.37 | 9 | 2.57 | $2.27\times10^{-3}$ mole Compd. I-/mole Ag |
| 6 | 0 | .05 | 4.65 | 31 | 2.30 | halide |

Results in Table V show Compound I acts as a development accelerator with iodobromide emulsion in that this compound increases the densities in the more heavily exposed areas. There is some reduction in density in the less heavily exposed areas. The overall effect is to increase the average gradient. The antifogging properties of Compound I are similar to that of the tetraazaindene compound.

EXAMPLE VI

The following coated emulsions were prepared: a control emulsion as described in Example I, a tetraazaindene control emulsion as described in Example IV, an emulsion made as described in Example I with Compound I added after digestion, and an emulsion made as described in Example I but in which the separate ingredients KBr, hydroquinone and imidazole were added after digestion. Fresh and oven aged samples were tested under Exposure A, and the results are in Table VI.

TABLE VI

| Ctg. No. | Test Age | Exposure A Dmin | Exposure A Dmax | Speed (D=1.0) | Ave. Grad. | Additive |
|---|---|---|---|---|---|---|
| 1 | F | .07 | 1.85 | 360 | 1.02 | Control-none |
| 2 | O | .48 | 2.30 | | .90 | |
| 3 | F | .08 | 1.38 | 100 | .72 | $1.76\times10^{-2}$ moles tetra-azaindene Cmpd./mole |
| 4 | O | .06 | 1.16 | | .43 | Ag halide |
| 5 | F | .07 | 2.35 | 69 | .94 | $2.27\times10^{-4}$ moles Cmpd. |
| 6 | O | .08 | 3.00 | 420 | 1.42 | I/mole Ag halide |
| 7 | F | .07 | 1.29 | 225 | .78 | $2.27\times10^{-4}$ mole KBr + $2.27\times10^{-4}$ moles hydro- |
| 8 | O | .35 | 1.91 | | | quinone + $2.27\times10^{-4}$ moles imidazole/mole Ag halide |

These data show that the combination of the separate ingredients, KBr, hydroquinone, and imidazole, is ineffective when compared to the hydrohalide compound. Specifically, the emulsion with Compound I incorporated therein exhibits average gradient but greater Dmax and superior antifogging character as compared to the emulsion in which the molecular constituents of dihydroxybenziimidazole hydrobromide were incorporated as separate ingredients.

EXAMPLE VII

Improvements in sensitometric properties can also be achieved by placing the dihydrobenzimidazole hydrohalide compounds in the developer solution instead of incorporating it in the photographic emulsion.

$8.6 \times 10^{-4}$ mole of Compound I/liter were added to a conventional halftone, low sulfite, hydroquinone developer containing as major ingredients hydroquinone, sodium formaldehyde bisulfite, sodium carbonate, sodium bicarbonate, sodium metabisulfite and potassium bromide. The developer without Compound I served as a control. A conventional lithographic film with an emulsion containing chlorobromide (70 mole % chloride/30% mole % bromide) grains was used as the test film. Samples were exposed to actinic radiation through a $\sqrt{2}$ step wedge and a magenta halftone contrast screen to actinic radiation equivalent to about 91 meter-candle-seconds. Development was for 120 seconds at 80° F. (~27° C.) and samples were fixed, washed and dried in the conventional manner. The results are given in Table VII.

TABLE VII

| Developer Variation | Speed 100/E at D=3.5 | Ave. Grad. | Base + Fog |
|---|---|---|---|
| Control | 21.9 | 16.9 | .04 |
| Control plus $8.6\times10^{-4}$ moles Compound I/liter | 30.2 | 11.4 | .05 |

The increase in speed shows the activity of Compound I in the developer as a development accelerator.

EXAMPLE VIII $7.0 \times 10^{-4}$ Moles of Compound II were added to a conventional, continuous tone metolhydroquinone developer containing as major ingredients hydroquinone, metol, sodium carbonate, sodium sulfite, sodium bisulfite, and potassium bromide. The developer without Compound II served as a control. Samples were exposed according to Exposure B of Example I except development was for 120 seconds at 80° F. (~27° C.). A conventional film containing $Pb^{+2}$ doped chlorobromide emulsion as described in Example I was used as the test film. Results, given below in Table VIII, show Compound III when used in the developer increases speed and average gradient without increasing fog.

TABLE VIII

| Developer Variation | Ave. Grad. | Speed 100E at D=3.5 | Base + Fog |
|---|---|---|---|
| Control | 3.5 | 105 | .07 |
| Control plus 7.04×10−4 moles Compd.III/liter | 4.1 | 112 | .06 |

EXAMPLE IX

Emulsions were prepared as in Example I with the following changes: digestion pH of 5.9, digestion temperature of 120° F. (~53° C.) and digestion time of 60 minutes. In addition, conventional orthochromatic dyes were added at digestion, and thallous nitrate was added after digestion as a developer accelerator. This emulsion served as a control. A test emulsion was prepared wherein Compound III was used instead of the thallous nitrate. Fresh and oven aged films were exposed under Exposure B of Example I except development was 120 seconds at 80° F. (~27° C.) in conventional continuous tone metol-hydroquinone developer described in Example VIII. Results, given in Table IX, show that Compound III increases speed, average gradient, and Dmax at lower fog than the thallous developer accelerator. In addition, Compound III is nonpoisonous whereas thallous salts are poisonous.

TABLE IX

| Variation | Test Age | Speed | Ave. Grad. | Dmax | Fog |
|---|---|---|---|---|---|
| Control: $7.33\times10^{-3}$ moles $TlNO_3$/mole Ag Halide | F | 161 | 3.23 | 4.86 | .14 |
| | O | 137 | 3.23 | 5.00+ | .11 |
| Test: $6.67\times10^{-4}$ moles of Compd. III/mole Ag Halide | F | 213 | 3.56 | 5.00+ | .11 |
| | O | 155 | 3.39 | 5.00+ | .09 |

It is well known in the art that if an emulsion gives higher Dmax and gradient, the coating weight can be proportionately lowered to obtain silver savings. The data given in Tables I, II, V and VI for Compound I show that superior top density and gradient are preserved after oven aging. As a result it would be possible to match the top density and gradient exhibited by the control emulsion by lowering the silver coating weight of the emulsion containing Compound I and thereby achieve a cost reduction.

Various modifications of the inventioin may occur to those skilled in the art, as long as it is understood that the dihydroxybenzimidazole hydrohalide is to be available when the photographic film or element is being developed. If, for example, these compounds are added to one of the layers of a photographic film other than the silver halide emulsion layer, (viz. an auxiliary layer) such layer may be contiguous to the silver halide emulsion layer or located on the reverse side of the support. Typical of the auxiliary layers which may serve for such purposes are those which also function to provide abrasion resistance, antihalation protection, improved adhesion, curl connection, antistatic protection, etc. These layers usually consist of gelatin, or other binder compatible with the emulsion layer, along with surfactants, hardening agents, dyes, polymers, etc. suitable for the function of the auxiliary layer and its incorporation into the film structure. The reason for the utility of these dihydroxybenzimidazole hydrohalide compounds in such diverse locations is that they need not be released until the film has been immersed in the developer solution. Generally the most suitable concentration range for use in such auxiliary layers would be $10^{-6}$ to $10^{-2}$ mole of compound per mole of silver halide or liter of developer solution.

I claim:

1. A photographic element comprising a support having thereon a light-sensitive silver halide emulsion layer, said layer containing a dihydroxybenzimidazole hydrohalide of the formula

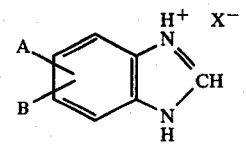

wherein A and B are hydroxy radicals in the 4,7 or 5,6 positions, and $X^-$ is $Br^-$, $Cl^-$ or $I^-$, the concentration of said hydrohalide being $5 \times 10^{-6}$ mole to $5 \times 10^{-2}$ mole/mole of silver halide.

2. The photographic element of claim 1 wherein said dihydroxybenzimidazole hydrohalide is 4,7-dihydroxybenzimidazole hydrobromide having the formula

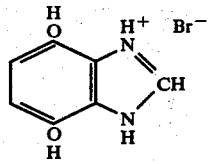

3. The photographic element of claim 1 wherein said dihydroxybenzimidazole hydrohalide is 4,7-dihydroxybenzimidazole hydrochloride having the formula

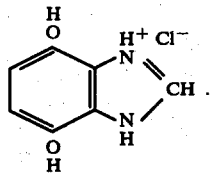

4. The photographic element of claim 1 wherein said dihydroxybenzimidazole hydrohalide is 4,7-dihydroxybenzimidazole hydroiodide having the formula

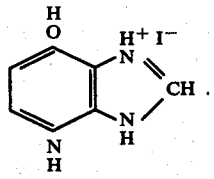

5. The photographic element of claim 1 wherein said dihydroxybenzimidazole hydrohalide is 5,6-dihydroxybenzimidazole hydrobromide having the formula

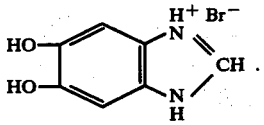

6. The photographic element of claim 1 wherein said dihydroxybenzimidazole hydrohalide is 5,6-dihydroxybenzimidazole hydrochloride having the formula

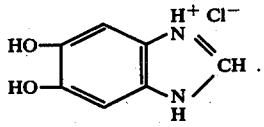

7. The photographic element of claim 1 wherein said dihydroxybenzimidazole hydrohalide is 5,6-dihydroxybenzimidazole hydroiodide having the formula

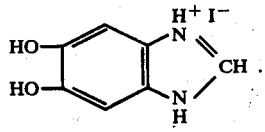

8. A photographic developer containing a silver halide developing agent and a dihydroxybenzimidazole hydrohalide of the formula

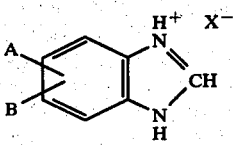

wherein A and B are hydroxy radicals in the 4,7 or 5,6 positions and $X^-$ represents $Br^-$, $Cl^-$ or $I^-$; said dihydroxybenzimidazole hydrohalide being present in an amount of $10^{-6}$ to $10^{-2}$ moles/liter of developing solution.

9. A photographic element comprising a support having thereon a light-sensitive silver halide emulsion layer and an auxiliary layer, said auxiliary layer containing a dihydroxybenzimidazole hydrohalide of the formula

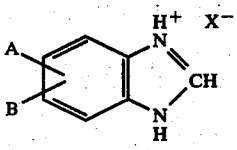

wherein A and B are hydroxy radicals in the 4,7 or 5,6 positions, and $X^-$ is $Br^-$, $Cl^-$ or $I^-$, the concentration of said hydrohalide being $10^{-6}$ to $10^{-2}$ mole per mole of silver halide.

10. The photographic element of claim 9 wherein said dihydroxybenizimidazole hydrohalide is 4,7-dihydroxybenzimidazole hydrobromide having the formula

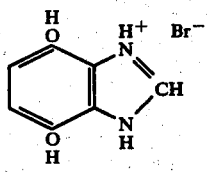

11. The photographic element of claim 9 wherein said dihydroxybenzimidazole hydrohalide is 4,7-dihydroxybenzimidazole hydrochloride having the formula

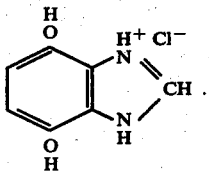

12. The photographic element of claim 9 wherein said dihydroxybenzimidazole hydrohalide is 4,7-dihydroxybenzimidazole hydroiodide having the formula

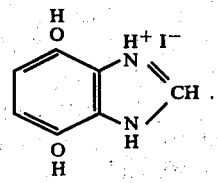

13. The photographic element of claim 9 wherein said dihydroxybenzimidazole hydrohalide is 5,6-dihydroxybenzimidazole hydrobromide having the formula

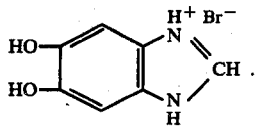

14. The photographic element of claim 9 wherein said dihydroxybenzimidazole hydrohalide is 5,6-dihydroxybenzimidazole hydrochloride having the formula

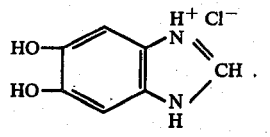

15. The photographic element of claim 9 wherein said dihydroxybenzimidazole hydrohalide is 5,6-dihydroxybenzimidazole hydroiodide having the formula

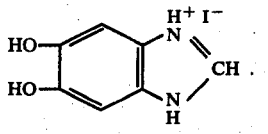

* * * * *